United States Patent [19]

Stephenson

[11] 4,022,291

[45] May 10, 1977

[54] EXHAUST MUFFLER HAVING AN ATTENUATER CAN ASSEMBLY

[75] Inventor: Donald K. Stephenson, Sussex, Wis.

[73] Assignee: Outboard Marine Corporation, Waukegan, Ill.

[22] Filed: Nov. 21, 1975

[21] Appl. No.: 634,073

[52] U.S. Cl. ..... 181/53; 181/33 D; 181/57; 181/60

[51] Int. Cl.[2] ..... F01N 1/08

[58] Field of Search ..... 181/33 D, 49, 53, 56–57, 181/60, 63

[56] References Cited

UNITED STATES PATENTS

| | | | |
|---|---|---|---|
| 2,194,928 | 3/1940 | Doyle | 181/60 |
| 2,739,661 | 3/1956 | Powers | 181/33 D |
| 3,754,620 | 8/1973 | Foster et al. | 181/56 |
| 3,776,366 | 12/1973 | Betts et al. | 181/57 |
| 3,853,201 | 12/1974 | Smale | 181/53 |

*Primary Examiner*—Lawrence R. Franklin
*Attorney, Agent, or Firm*—Michael, Best & Friedrich

[57] ABSTRACT

Disclosed herein is a muffler comprising an elongated tubular housing having an outer wall partially defining a chamber, an inlet pipe extending through the tubular housing for communication with the chamber, and an attenuater can assembly secured to the tubular housing and including an attenuater can having a first end wall, a second end wall, and a perforated cylindrical sidewall extending between the end walls and located within the chamber, which assembly also includes an outlet pipe extending exteriorly of the housing from within the attenuater can through the first end wall for communication with the environment outside the tubular housing.

5 Claims, 3 Drawing Figures

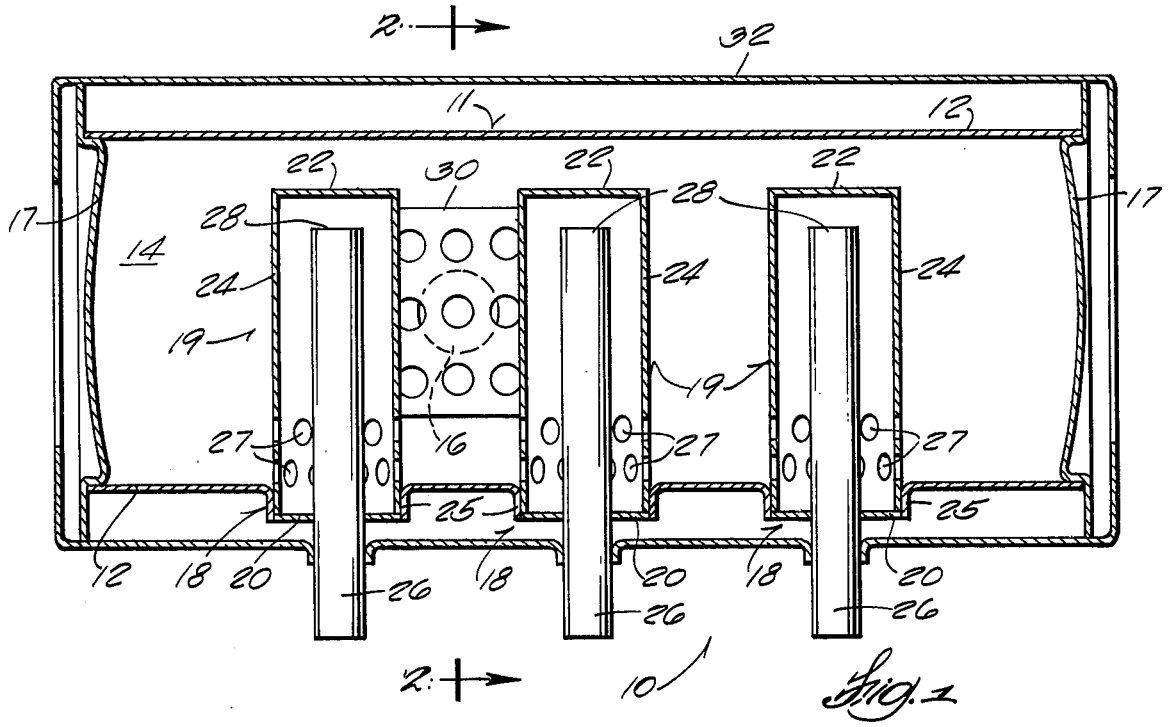
Fig. 1
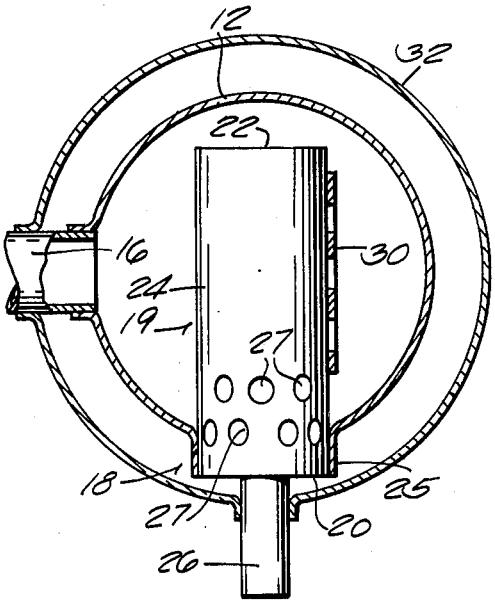
Fig. 2
Fig. 3
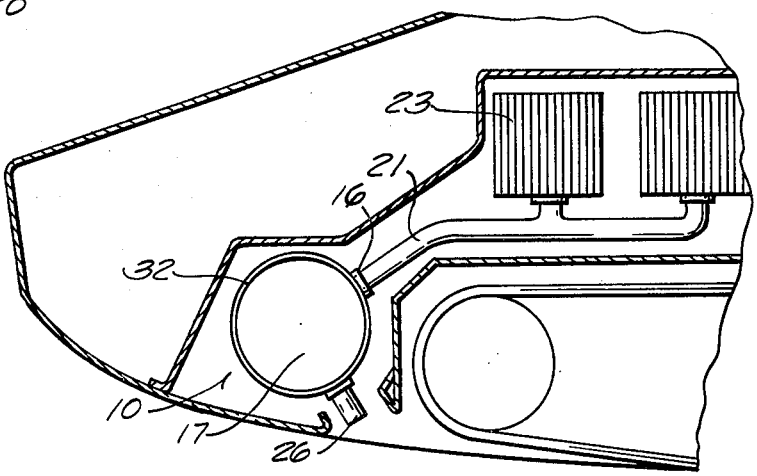

EXHAUST MUFFLER HAVING AN ATTENUATER CAN ASSEMBLY

BACKGROUND OF THE INVENTION

The invention relates to exhaust mufflers for internal combustion engines and more particularly to exhaust mufflers particularly adapted for use on snowmobiles. Prior muffler constructions are disclosed in the pending U.S. application Ser. No. 451,203, filed Mar. 14, 1974 and in the following U.S. Pat. Nos:

Betts et al., 3,776,366, issued Dec. 4, 1973
Jozepaitis, 3,419,107, issued Dec. 31, 1968
Bryant, 2,960,179, issued Nov. 15, 1960
Bryant, 2,825,421, issued Mar. 4, 1958
Bryant, 2,520,756, issued Aug. 29, 1950
Chipley, 2,239,549, issued Apr. 22, 1941
Powell, 1,998,385, issued Apr. 16, 1935

SUMMARY OF THE INVENTION

The invention provides a muffler comprising an elongated tubular housing having an outer wall partially defining a chamber, an inlet pipe extending through the tubular housing for communication with the chamber, and an attenuater can assembly secured to the tubular housing and including an attenuater can having a first end wall, a second end wall, and a perforated cylindrical sidewall extending between the end walls and located within the chamber, the assembly also including an outlet pipe extending exteriorly of the housing from within the attenuater can through the first end wall for communication with the environment outside the tubular housing.

In accordance with an embodiment of the invention the cylindrical sidewall is perforated within the chamber adjacent the first end wall of the attenuater can and the outlet pipe includes an inlet located adjacent the second end wall of the attenuater can.

Also in accordance with an embodiment of the invention the inlet pipe extends through the outer wall, the first end wall of the attenuater can is secured to the outer wall, the cylindrical sidewall of the attenuater can extends generally perpendicular to the outer wall of the tubular housing, and the outlet pipe extends through the outer wall.

Still further in accordance with an embodiment of the invention the inlet pipe extends through the outer wall generally perpendicular to the outlet pipe extending through the outer wall and the first end wall of the attenuater can is secured to and is generally coincident with the outer wall of the tubular housing.

Still further in accordance with an embodiment of the invention, the invention provides a muffler including three attenuater can assemblies.

One of the principal features of the invention is the provision of a muffler which has superior noise attenuation capability but does not substantially adversely affect engine performance, the muffler comprising an elongated tubular housing having an outer wall partially defining a chamber and one or more attenuater can assemblies, each including an attenuater can having a first end wall, a second end wall, and a perforated cylindrical sidewall extending between the end walls and located within the chamber, which sidewall has perforations located adjacent the first end wall, each assembly also including an outlet pipe extending from within the attenuater can through the first end wall for communication with the environment outside the tubular housing.

Another of the principal features of the invention is the provision of a muffler having an outlet pipe including an inlet located adjacent the second end wall to in effect tune the muffler to particularly attenuate a dominant higher frequency, thus providing a muffler with superior noise attenuation characteristics which produces a more pleasing lower frequency tone.

Another of the principal features of the invention is the provision of a muffler having an inlet pipe extending through the outer wall and an outlet pipe extending through the outer wall generally perpendicular to the inlet pipe to facilitate use of the muffler on snowmobiles.

Another of the principal features of the invention is the provision of a muffler having one or more attenuater can assemblies which apparently prevent the explosion of unburned exhaust gases within the muffler.

Other features and advantages of the embodiments of the invention will become known by reference to the following general description, appended claims, and drawings.

BRIEF DESCRIPTION OF THE DRAWINGS

FIG. 1 is a side sectional view of a muffler embodying various of the features of the invention.

FIG. 2 is a sectional view taken along line 2—2 of FIG. 1.

FIG. 3 is a schematic view of a muffler embodying various of the features of the invention mounted in a snowmobile.

Before explaining the embodiments of the invention in detail, it is to be understood that the invention is not limited in its application to the details of construction and the arrangement of the components as set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in the drawings is a muffler 10 which embodies various of the features of the invention and which includes an elongated tubular housing 11 having an outer tubular wall 12 partially defining a chamber 14. End closures 17 are secured at the opposite ends of the outer wall 12 to further define the chamber 14. An inlet pipe 16 extends through the tubular housing 11 for communication with the chamber 14. Various arrangements can be employed, and in the disclosed muffler 10, the inlet pipe 16 extends through the tubular outer wall 12 generally perpendicularly to outlet pipes 26 (described below) also extending through the tubular outer wall 12. As shown in FIG. 3, the inlet pipe 16 can be connected to an engine exhaust pipe 21 so that the muffler 10 is particularly suited for use on a snowmobile.

An attenuater can assembly 18 (three shown in the drawings) is secured to the tubular housing 11 and includes an attenuater can 19 having a first end wall 20, a second end wall 22 and a perforated cylindrical sidewall 24 extending between the end walls and located within the chamber 14. The attenuater can assembly 18 also includes an outlet pipe 26 extending exteriorly of the tubular housing 11 from within the attenuater can 19 through the first end wall 20 for communication with the environment outside the tubular housing 11. The outlet pipe 26 can be supported within the attenuater can 19 by conventional means such as brackets (not shown) and extends through an aperture in the first end wall 20.

A heat deflection shield 30 having a perforated surface is mounted opposite the inlet pipe 16 to dissipate and distribute the hot slugs of gas (not shown) produced from the engine exhaust. An external cylindrical heat shield 32 can also be provided and, as shown, is secured to and extends around the outer wall 12, which shield includes apertures for the outlet pipes 26 extending through the outer wall 12.

The number of attenuater can assemblies 18 included in the muffler structure and the means of securing the assemblies to the tubular housing 11 can be varied. In the preferred construction shown, three attenuater can assemblies are secured to the tubular housing 11, the tubular housing preferably having a diameter on the order of seven inches. The first end wall 20 of each of the attenuater cans 19 is secured to and is coincident with the outer wall 12. Various arrangements can be employed and in the preferred construction each of the first end walls 20 is secured to a cylindrical lip 25 bordering an aperture in the outer wall 12. Preferably the cylindrical sidewalls 24, each having a diameter on the order of 2½ inches, extend generally perpendicularly to the outer wall 12 and the perforations 27 of the cylindrical sidewalls 24 are located adjacent the first end walls 20 within the chamber 14. Preferably, the outlet pipes 26, each having a diameter on the order of one inch and a length on the order of 9½ inches, have an inlet 28 which is located adjacent the second end wall 22.

During the operation of the engine 23, (shown schematically in FIG. 3) the exhaust gases (not shown) from the engine enter the inlet pipe 16 and strike the heat deflection shield 30, which exhaust gases then partially dissipate or smooth out within the chamber 14. Sound attenuation takes place within the relatively large chamber 14 through the recognized process of reflection and cancellation.

In order not to substantially adversely affect engine performance, the allowable pressure drop or back pressure across the muffler structure must be limited. It has been found that good attenuation results are obtained by saving as much of the allowable pressure drop as possible for the point where the exhaust gases flow through the perforations 27 in the cylindrical sidewalls 24; the exhaust gases flowing with substantially less pressure drop through the chamber 14 and through the exhaust pipes 26 to the environment outside the tubular housing 11.

In the disclosed muffler 10, two columns of circular perforations 27, each perforation preferably having a diameter on the order of ½ inch, are located adjacent each of the first end walls 20. Sound attenuation and a substantial portion of the allowable pressure drop occurs as the exhaust gases flow through the small areas of the perforations 27. Since large portions of the cylindrical sidewalls 24 are not perforated, sound attenuation takes place as the exhaust gases travel toward the inlets 28 of the outlet pipes 26, again through the recognized process of reflection and cancellation. Because of the transitional area change, sound attenuation also occurs as the exhaust gases enter the inlet 28 and exit from the outlet pipe 26. In addition, sound attenuation occurs within the outlet pipe 26, again through the process of reflection and cancellation.

A particular attenuation of a dominant higher frequency is obtained by positioning the inlets 28 of the outlet pipes 26 adjacent the end walls 22. It is believed that the particular sound attenuation of a dominant higher frequency occurs because each of the inlets 28 is positioned at a node in the standing wave of the dominant higher frequency. As a result, the muffler produces a more pleasing lower tone. In the muffler disclosed, the inlet 28 is positioned from the second end wall 22 a distance on the order of nine-tenths of an inch.

The disclosed muffler 10 also apparently eliminates or substantially reduces the problem of muffler backfire or popback. It is believed that the relatively small volume of each of the attenuater can assemblies and the small area of the perforations located adjacent the first end walls prevents the mixing of oxygen from the environment outside the tubular housing with a sufficient amount of unburned exhaust gases within the muffler to result in an explosion of unburned exhaust gases within the muffler structure.

It is to be particularly understood that the invention disclosed herein provides a muffler which has superior sound attenuation capabilities, which particularly attenuates a dominant higher frequency to produce a more pleasing lower tone, and which apparently prevents or substantially eliminates the problem of backfire within the muffler structure.

Various of the features of the invention are set forth in the following claims:

What is claimed is:

1. A muffler comprising an elongated tubular housing having an elongated axis and an outer wall extending parallel to said axis and partially defining a chamber, an inlet pipe extending radially with respect to said axis and through said outer wall for communication with said chamber and a plurality of attenuater can assemblies extending in parallel relation to each other and each including an attenuater can having a first end wall secured to and coincident with said outer wall, a second end wall and a cylindrical sidewall extending between said end walls and located within said chamber and extending generally perpendicularly to said outer wall of said tubular housing, said cylindrical sidewall having perforations within said chamber adjacent said first end wall, each said assembly also including an outlet pipe having an inlet located within said attenuater can adjacent said second end wall, said outlet pipe extending radially with respect to said axis and through said first end wall and through and beyond said outer wall for communication with the environment outside said tubular housing.

2. A muffler in accordance with claim 1 wherein said inlet pipe extends through said outer wall generally perpendicularly to said outlet pipe.

3. A muffler in accordance with claim 1 including three attenuater can assemblies.

4. A muffler in accordance with claim 3 including a heat deflection shield located within said chamber opposite said inlet pipe.

5. A muffler in accordance with claim 4 including an external cylindrical heat shield extending around said outer wall, said heat shield including apertures for said outlet pipes extending through said outer wall.

* * * * *